US007339146B2

(12) United States Patent
Aisenbrey

(10) Patent No.: US 7,339,146 B2
(45) Date of Patent: Mar. 4, 2008

(54) LOW COST MICROWAVE OVER COMPONENTS MANUFACTURED FROM CONDUCTIVELY DOPED RESIN-BASED MATERIALS

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 0 days.

(21) Appl. No.: 11/328,977

(22) Filed: Jan. 10, 2006

(65) Prior Publication Data

US 2006/0118554 A1 Jun. 8, 2006

Related U.S. Application Data

(63) Continuation-in-part of application No. 10/877,092, filed on Jun. 25, 2004, which is a continuation of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/642,753, filed on Jan. 10, 2005, provisional application No. 60/317,808, filed on Sep. 7, 2001, provisional application No. 60/269,414, filed on Feb. 16, 2001, provisional application No. 60/268,822, filed on Feb. 15, 2001.

(51) Int. Cl.
*H05B 6/46* (2006.01)
*H01J 25/50* (2006.01)

(52) U.S. Cl. ..... 219/761; 315/39.51

(58) Field of Classification Search ..... 219/761, 219/678, 725, 728; 315/39.51, 39.77; 331/86, 331/91; *H05B 6/46; H01J 25/50*
See application file for complete search history.

(56) References Cited

U.S. PATENT DOCUMENTS

| | | | | |
|---|---|---|---|---|
| 4,555,606 | A * | 11/1985 | Thomas et al. | 219/757 |
| 5,347,108 | A * | 9/1994 | Minakawa et al. | 219/696 |
| 6,909,590 | B2 * | 6/2005 | Sato et al. | 361/302 |
| 6,956,456 | B2 * | 10/2005 | Mihara et al. | 336/178 |
| 2004/0239464 | A1 * | 12/2004 | Mihara et al. | 336/83 |

* cited by examiner

*Primary Examiner*—Daniel Robinson
(74) *Attorney, Agent, or Firm*—Douglas Schnabel

(57) ABSTRACT

Microwave oven components are formed of a conductively doped resin-based material. The conductively doped resin-based material comprises micron conductive powder(s), conductive fiber(s), or a combination of conductive powder and conductive fibers in a base resin host. The percentage by weight of the conductive powder(s), conductive fiber(s), or a combination thereof is between about 20% and 50% of the weight of the conductively doped resin-based material. The micron conductive powders are metals or conductive non-metals or metal plated non-metals. The micron conductive fibers may be metal fiber or metal plated fiber. Further, the metal plated fiber may be formed by plating metal onto a metal fiber or by plating metal onto a non-metal fiber. Any platable fiber may be used as the core for a non-metal fiber. Superconductor metals may also be used as micron conductive fibers and/or as metal plating onto fibers in the present invention.

21 Claims, 5 Drawing Sheets

LOW COST MICROWAVE OVER COMPONENTS MANUFACTURED FROM CONDUCTIVELY DOPED RESIN-BASED MATERIALS

RELATED PATENT APPLICATIONS

This Patent Application claims priority to the U.S. Provisional Patent Application 60/642,753 filed on Jan. 10, 2005, which is herein incorporated by reference in its entirety.

This Patent application is a Continuation-in-Part of INT01-002CIPC, filed as U.S. patent application Ser. No. 10/877,092, filed on Jun. 25, 2004, filed as U.S. patent application Ser. No. 10/309,429, filed on Dec. 4, 2002, now issued as U.S. Pat. No. 6,870,516, also incorporated by reference in its entirety, filed as U.S. patent application Ser. No. 10/075,778, filed on Feb. 14, 2002, now issued as U.S. Pat. No. 6,741,221, which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001, all of which are incorporated by reference in their entirety.

BACKGROUND OF THE INVENTION (1) Field of the Invention

This invention relates to microwave oven components and, more particularly, to microwave oven components molded of conductively doped resin-based materials comprising micron conductive powders, micron conductive fibers, or a combination thereof, substantially homogenized within a base resin when molded. This manufacturing process yields a conductive part or material usable within the EMF, thermal, acoustic, or electronic spectrum(s)

(2) Description of the Prior Art

Microwave energy provides rapid food heating. Microwave ovens typically comprise a microwave producing magnetron device and a cooking chamber. Microwaves are typically manufactured from a combination of metal components—for a chassis, magnetron, cooking chamber, and a waveguide to direct the microwave energy into the chamber—and plastic components—for control panels and windows. While the size of microwave ovens has been substantially reduced in recent years, the units still weigh a considerable amount due to the metal components. In addition, metal components are manufactured by stamping, bending, machining, and forming operations that are complex and expensive to perform. A primary objective of the present invention is to provide high quality, low cost microwave components manufactured from a unique material that combines advantages of metal and plastic materials.

Several prior art inventions relate to microwave ovens and components thereof. U.S. Patent Publication US 2004/0084446 A1 to Perego et al teaches a thermoplastic resin article comprising a high heat thermoplastic resin such as polyetherimide, and a ferrite, and/or silicon carbide formed by injection molding and used as a dish suitable for browning an item that is cooked in a microwave oven. U.S. Patent Publication US 2001/0002670 A1 to Omori et al teaches a Microwave oven that utilizes a magnetron antenna and a diffusion antenna attached to the wave guide for a more even cooking distribution of the microwaves to eliminate heat unevenness of the food in the heat chamber. U.S. Patent Publication US 2004/0134905 A1 to Noda et al teaches a microwave oven capable of changing the way to supply microwaves into the heating chamber by adding an antenna moving unit. U.S. Patent Publication US 2004/0069765 A1 to Lee et al teaches a combined toaster and microwave oven. U.S. Patent publication US 2003/0230570 A1 to Kim teaches a microwave oven that utilizes a wave dispersing unit on the top and a second wave dispersing fan unit on the side of the oven enabling a more even cooking distribution.

SUMMARY OF THE INVENTION

A principal object of the present invention is to provide an effective microwave oven component or device.

A further object of the present invention is to provide a method to form a microwave oven component or device.

A further object of the present invention is to provide microwave oven components molded of conductively doped resin-based materials.

A yet further object of the present invention is to provide microwave oven components molded of conductively doped resin-based material where the electromagnetic, electrical, thermal, acoustical, or visual characteristics can be altered or the visual characteristics can be altered by forming a metal layer over the conductively doped resin-based material.

A yet further object of the present invention is to provide a microwave magnetron case exhibiting both low weight and excellent thermal dissipation.

A yet further object of the present invention is to provide a microwave wave guide exhibiting excellent microwave transmission capability.

A yet further object of the present invention is to provide a microwave oven cooking chamber exhibiting excellent energy control.

A yet further object of the present invention is to provide a microwave oven chassis exhibiting both low weight and excellent energy control.

A yet further object of the present invention is to provide a microwave oven wave dispersing fan exhibiting excellent wave breakup and low weight.

A yet further object of the present invention is to provide a microwave oven antenna exhibiting excellent energy radiation.

A yet further object of the present invention is to provide a method to form microwave components of intricate detail and with simplicity of manufacture.

In accordance with the objects of this invention, a microwave oven device is achieved. The device comprises a magnetron capable of generating microwave energy. The magnetron comprises conductively doped, resin-based material comprising conductive materials in a base resin host. A cooking chamber is electromagnetically coupled to the magnetron.

Also in accordance with the objects of this invention, a microwave oven device is achieved. The device comprises a magnetron capable of generating microwave energy. The magnetron comprises conductively doped, resin-based material comprising micron conductive fiber in a base resin host. A cooking chamber is electromagnetically coupled to the magnetron.

Also in accordance with the objects of this invention, a method to form a microwave oven component is achieved. The method comprises providing a conductively doped, resin-based material comprising conductive materials in a resin-based host. The conductively doped, resin-based material is molded into a microwave oven component.

BRIEF DESCRIPTION OF THE DRAWINGS

In the accompanying drawings forming a material part of this description, there is shown.

DESCRIPTION OF THE PREFERRED EMBODIMENTS

Figure 1:
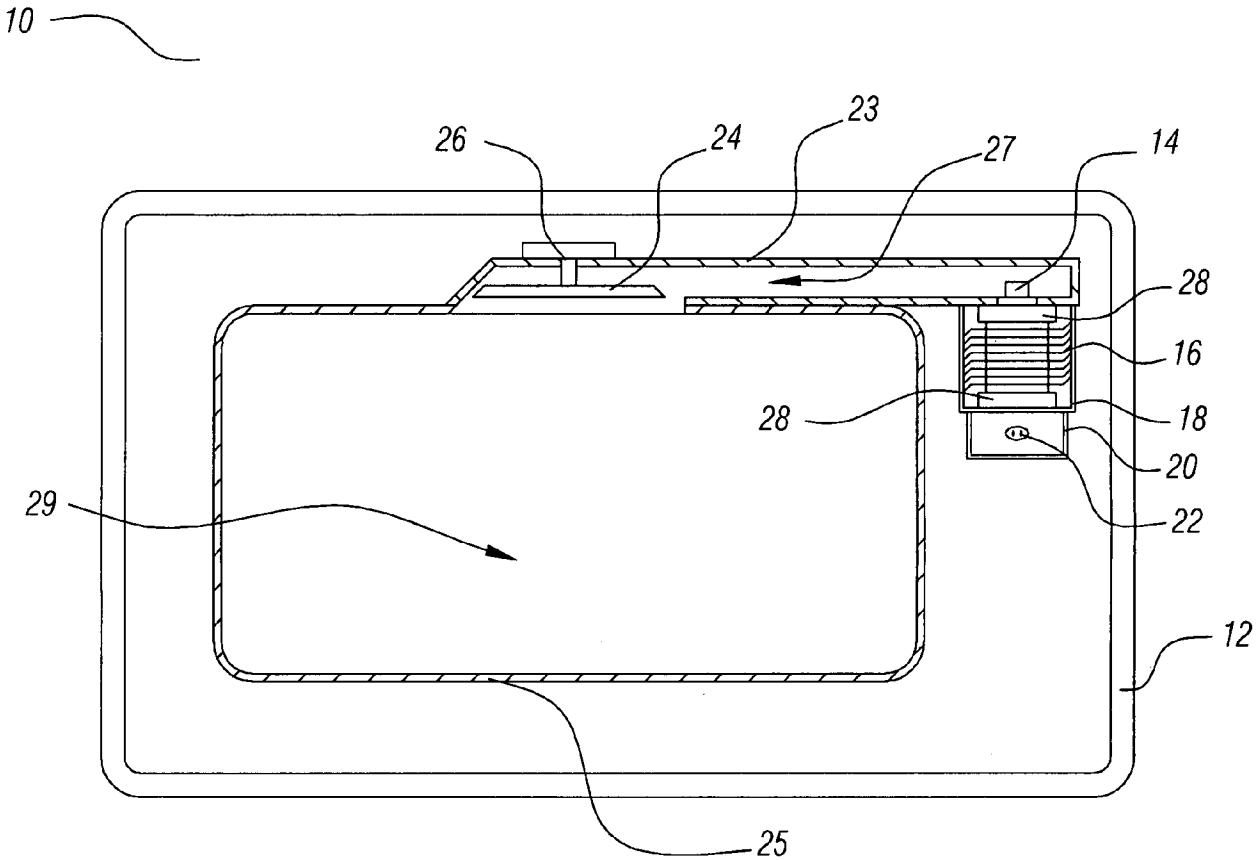
FIG. 1 illustrates an embodiment of a microwave oven device having various components comprising a conductively doped resin-based material.

This invention relates to microwave oven components molded of conductively doped resin-based materials comprising micron conductive powders, micron conductive fibers, or a combination thereof, substantially homogenized within a base resin when molded.

The conductively doped resin-based materials of the invention are base resins doped with conductive materials to convert the base resin from an insulator to a conductor. The base resin provides structural integrity to the molded part. The doping material, such as micron conductive fibers, micron conductive powders, or a combination thereof, is substantially homogenized within the resin during the molding process. The resulting conductively doped resin-based material provides electrical, thermal, and acoustical continuity.

The conductively doped resin-based materials can be molded, extruded or the like to provide almost any desired shape or size. The molded conductively doped resin-based materials can also be cut, stamped, or vacuumed formed from an injection molded or extruded sheet or bar stock, over-molded, laminated, milled or the like to provide the desired shape and size. The thermal, electrical, and acoustical continuity and/or conductivity characteristics of articles or parts fabricated using conductively doped resin-based materials depend on the composition of the conductively doped resin-based materials. The type of base resin, the type of doping material, and the relative percentage of doping material incorporated into the base resin can be adjusted to achieve the desired structural, electrical, or other physical characteristics of the molded material. The selected materials used to fabricate the articles or devices are substantially homogenized together using molding techniques and or methods such as injection molding, over-molding, insert molding, compression molding, thermo-set, protrusion, extrusion, calendaring, or the like. Characteristics related to 2D, 3D, 4D, and 5D designs, molding and electrical characteristics, include the physical and electrical advantages that can be achieved during the molding process of the actual parts and the molecular polymer physics associated within the conductive networks within the molded part(s) or formed material(s).

In the conductively doped resin-based material, electrons travel from point to point, following the path of least resistance. Most resin-based materials are insulators and represent a high resistance to electron passage. The doping of the conductive loading into the resin-based material alters the inherent resistance of the polymers. At a threshold concentration of conductive loading, the resistance through the combined mass is lowered enough to allow electron movement. Speed of electron movement depends on conductive doping concentration and material makeup, that is, the separation between the conductive doping particles. Increasing conductive loading content reduces interparticle separation distance, and, at a critical distance known as the percolation point, resistance decreases dramatically and electrons move rapidly.

Resistivity is a material property that depends on the atomic bonding and on the microstructure of the material. The atomic microstructure material properties within the conductively doped resin-based material are altered when molded into a structure. A substantially homogenized conductive microstructure of delocalized valance electrons is created within the valance and conduction bands of the molecules. This microstructure provides sufficient charge carriers within the molded matrix structure. As a result, a low density, low resistivity, lightweight, durable, resin based polymer microstructure material is achieved. This material exhibits conductivity comparable to that of highly conductive metals such as silver, copper or aluminum, while maintaining the superior structural characteristics found in many plastics and rubbers or other structural resin based materials.

Conductively doped resin-based materials lower the cost of materials and of the design and manufacturing processes needed for fabrication of molded articles while maintaining close manufacturing tolerances. The molded articles can be manufactured into infinite shapes and sizes using conventional forming methods such as injection molding, over-molding, compression molding, thermoset molding, or extrusion, calendaring, or the like. The conductively doped resin-based materials, when molded, typically but not exclusively produce a desirable usable range of resistivity of less than about 5 to more than about 25 ohms per square, but other resistivities can be achieved by varying the dopant(s), the doping parameters and/or the base resin selection(s).

The conductively doped resin-based materials comprise micron conductive powders, micron conductive fibers, or any combination thereof, which are substantially homogenized together within the base resin, during the molding process, yielding an easy to produce low cost, electrical, thermal, and acoustical performing, close tolerance manufactured part or circuit. The resulting molded article comprises a three dimensional, continuous capillary network of conductive doping particles contained and or bonding within the polymer matrix. Exemplary micron conductive powders include carbons, graphites, amines, eeonomers, or the like, and/or of metal powders such as nickel, copper, silver, aluminum, nichrome, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment.

Carbon nano-tubes may be added to the conductively doped resin-based material. The addition of conductive powder to the micron conductive fiber doping may improve the electrical continuity on the surface of the molded part to offset any skinning effect that occurs during molding.

The micron conductive fibers may be metal fiber or metal plated fiber. Further, the metal plated fiber may be formed by plating metal onto a metal fiber or by plating metal onto a non-metal fiber. Exemplary metal fibers include, but are not limited to, stainless steel fiber, copper fiber, nickel fiber, silver fiber, aluminum fiber, nichrome fiber, or the like, or combinations thereof. Exemplary metal plating materials include, but are not limited to, copper, nickel, cobalt, silver, gold, palladium, platinum, ruthenium, rhodium, and nichrome, and alloys of thereof. Any platable fiber may be used as the core for a non-metal fiber. Exemplary non-metal fibers include, but are not limited to, carbon, graphite, polyester, basalt, melamine, man-made and naturally-occurring materials, and the like. In addition, superconductor metals, such as titanium, nickel, niobium, and zirconium, and alloys of titanium, nickel, niobium, and zirconium may also be used as micron conductive fibers and/or as metal plating onto fibers in the present invention.

Where micron fiber is combined with base resin, the micron fiber may be pretreated to improve performance. According to one embodiment of the present invention, conductive or non-conductive powders are leached into the fibers prior to extrusion. In other embodiments, the fibers are subjected to any or several chemical modifications in order to improve the fibers interfacial properties. Fiber modification processes include, but are not limited to: chemically inert coupling agents; gas plasma treatment; anodizing; mercerization; peroxide treatment; benzoylation; or other chemical or polymer treatments.

Chemically inert coupling agents are materials that are molecularly bonded onto the surface of metal and or other fibers to provide surface coupling, mechanical interlocking, inter-diffusion and adsorption and surface reaction for later bonding and wetting within the resin-based material. This chemically inert coupling agent does not react with the resin-based material. An exemplary chemically inert coupling agent is silane. In a silane treatment, silicon-based molecules from the silane bond to the surface of metal fibers to form a silicon layer. The silicon layer bonds well with the subsequently extruded resin-based material yet does not react with the resin-based material. As an additional feature during a silane treatment, oxane bonds with any water molecules on the fiber surface to thereby eliminate water from the fiber strands. Silane, amino, and silane-amino are three exemplary pre-extrusion treatments for forming chemically inert coupling agents on the fiber.

In a gas plasma treatment, the surfaces of the metal fibers are etched at atomic depths to re-engineer the surface. Cold temperature gas plasma sources, such as oxygen and ammonia, are useful for performing a surface etch prior to extrusion. In one embodiment of the present invention, gas plasma treatment is first performed to etch the surfaces of the fiber strands. A silane bath coating is then performed to form a chemically inert silicon-based film onto the fiber strands. In another embodiment, metal fiber is anodized to form a metal oxide over the fiber. The fiber modification processes described herein are useful for improving interfacial adhesion, improving wetting during homogenization, and/or reducing oxide growth (when compared to non-treated fiber). Pretreatment fiber modification also reduces levels of particle dust, fines, and fiber release during subsequent capsule sectioning, cutting or vacuum line feeding.

The resin-based structural material may be any polymer resin or combination of compatible polymer resins. Non-conductive resins or inherently conductive resins may be used as the structural material. Conjugated polymer resins, complex polymer resins, and/or inherently conductive resins may be used as the structural material. The dielectric properties of the resin-based material will have a direct effect upon the final electrical performance of the conductively doped resin-based material. Many different dielectric properties are possible depending on the chemical makeup and/or arrangement, such as linking, cross-linking or the like, of the polymer, co-polymer, monomer, ter-polymer, or homo-polymer material. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material doped with micron conductive powders, micron conductive fibers, or in combination thereof can be molded, using conventional molding methods such as injection molding or over-molding, or extrusion to create desired shapes and sizes. The molded conductively doped resin-based materials can also be stamped, cut or milled as desired to form create the desired shapes and form factor(s). The doping composition and directionality associated with the micron conductors within the doped base resins can affect the electrical and structural characteristics of the articles and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming articles that could be embedded in a person's clothing as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductively doped resin-based material may also be formed into a prepreg laminate, cloth, or webbing. A laminate, cloth, or webbing of the conductively doped resin-based material is first homogenized with a resin-based material. In various embodiments, the conductively doped resin-based material is dipped, coated, sprayed, and/or extruded with resin-based material to cause the laminate, cloth, or webbing to adhere together in a prepreg grouping that is easy to handle. This prepreg is placed, or laid up, onto a form and is then heated to form a permanent bond. In another embodiment, the prepreg is laid up onto the impregnating resin while the resin is still wet and is then cured by heating or other means. In another embodiment, the wet lay-up is performed by laminating the conductively doped resin-based prepreg over a honeycomb structure. In another embodiment, the honeycomb structure is made from conductively doped, resin-based material. In yet another embodiment, a wet prepreg is formed by spraying, dipping, or coating the conductively doped resin-based material laminate, cloth, or webbing in high temperature capable paint.

Prior art carbon fiber and resin-based composites are found to display unpredictable points of failure. In carbon fiber systems there is little if any elongation of the structure. By comparison, in the present invention, the conductively doped resin-based material, even if formed with carbon fiber or metal plated carbon fiber, displays greater strength of the mechanical structure due to the substantial homogenization of the fiber created by the moldable capsules. As a result a structure formed of the conductively doped resin-based material of the present invention will maintain structurally even if crushed while a comparable carbon fiber composite will break into pieces.

The conductively doped resin-based material of the present invention can be made resistant to corrosion and/or metal electrolysis by selecting micron conductive fiber and/or micron conductive powder dopants and base resins that are resistant to corrosion and/or metal electrolysis. For example, if a corrosion/electrolysis resistant base resin is combined with fibers/powders or in combination of such as stainless steel fiber, inert chemical treated coupling agent warding against corrosive fibers such as copper, silver and gold and or carbon fibers/powders, then corrosion and/or metal electrolysis resistant conductively doped resin-based material is achieved. Another additional and important feature of the present invention is that the conductively doped resin-based material of the present invention may be made flame retardant. Selection of a flame-retardant (FR) base resin material allows the resulting product to exhibit flame retardant capability. This is especially important in applications as described herein.

The substantially homogeneous mixing of micron conductive fiber and/or micron conductive powder and base resin described in the present invention may also be described as doping. That is, the substantially homogeneous mixing transforms a typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the substantially homogeneous mixing of micron conductive fiber and/or micron conductive powder within a base resin.

As an additional and important feature of the present invention, the molded conductor doped resin-based material exhibits excellent thermal dissipation characteristics. Therefore, articles manufactured from the molded conductor doped resin-based material can provide added thermal dissipation capabilities to the application. For example, heat can be dissipated from electrical devices physically and/or electrically connected to an article of the present invention.

As a significant advantage of the present invention, articles constructed of the conductively doped resin-based material can be easily interfaced to an electrical circuit or grounded. In one embodiment, a wire can be attached to conductively doped resin-based articles via a screw that is fastened to the article. For example, a simple sheet-metal type, self tapping screw can, when fastened to the material, can achieve excellent electrical connectivity via the conductive matrix of the conductively doped resin-based material. To facilitate this approach a boss may be molded as part of the conductively doped resin-based material to accommodate such a screw. Alternatively, if a solderable screw material, such as copper, is used, then a wire can be soldered to the screw is embedded into the conductively doped resin-based material. In another embodiment, the conductively doped resin-based material is partly or completely plated with a metal layer. The metal layer forms excellent electrical conductivity with the conductive matrix. A connection of this metal layer to another circuit or to ground is then made. For example, if the metal layer is solderable, then a soldered connection may be made between the article and a grounding wire.

Where a metal layer is formed over the surface of the conductively doped resin-based material, any of several techniques may be used to form this metal layer. This metal layer may be used for visual enhancement of the molded conductively doped resin-based material article or to otherwise alter performance properties. Well-known techniques, such as electroless metal plating, electro plating, electrolytic metal plating, sputtering, metal vapor deposition, metallic painting, or the like, may be applied to the formation of this metal layer. If metal plating is used, then the resin-based structural material of the conductively doped, resin-based material is one that can be metal plated. There are many of the polymer resins that can be plated with metal layers. For example, GE Plastics, SUPEC, VALOX, ULTEM, CYCOLAC, UGIKRAL, STYRON, CYCOLOY are a few resin-based materials that can be metal plated. Electroless plating is typically a multiple-stage chemical process where, for example, a thin copper layer is first deposited to form a conductive layer. This conductive layer is then used as an electrode for the subsequent plating of a thicker metal layer.

A typical metal deposition process for forming a metal layer onto the conductively doped resin-based material is vacuum metallization. Vacuum metallization is the process where a metal layer, such as aluminum, is deposited on the conductively doped resin-based material inside a vacuum chamber. In a metallic painting process, metal particles, such as silver, copper, or nickel, or the like, are dispersed in an acrylic, vinyl, epoxy, or urethane binder. Most resin-based materials accept and hold paint well, and automatic spraying systems apply coating with consistency. In addition, the excellent conductivity of the conductively doped resin-based material of the present invention facilitates the use of extremely efficient, electrostatic painting techniques.

The conductively doped resin-based materials can be contacted in any of several ways. In one embodiment, a pin is embedded into the conductively doped resin-based material by insert molding, ultrasonic welding, pressing, or other means. A connection with a metal wire can easily be made to this pin and results in excellent contact to the conductively doped resin-based material conductive matrix. In another embodiment, a hole is formed in to the conductively doped resin-based material either during the molding process or by a subsequent process step such as drilling, punching, or the like. A pin is then placed into the hole and is then ultrasonically welded to form a permanent mechanical and electrical contact. In yet another embodiment, a pin or a wire is soldered to the conductively doped resin-based material. In this case, a hole is formed in the conductively doped resin-based material either during the molding operation or by drilling, stamping, punching, or the like. A solderable layer is then formed in the hole. The solderable layer is preferably formed by metal plating. A conductor is placed into the hole and then mechanically and electrically bonded by point, wave, or reflow soldered.

Another method to provide connectivity to the conductively doped resin-based material is through the application of a solderable ink film to the surface. One exemplary solderable ink is a combination of copper and solder particles in an epoxy resin binder. The resulting mixture is an active, screen-printable and dispensable material. During curing, the solder reflows to coat and to connect the copper particles and to thereby form a cured surface that is directly solderable without the need for additional plating or other processing steps. Any solderable material may then be mechanically and/or electrically attached, via soldering, to the conductively doped resin-based material at the location of the applied solderable ink. Many other types of solderable inks can be used to provide this solderable surface onto the conductively doped resin-based material of the present invention. Another exemplary embodiment of a solderable ink is a mixture of one or more metal powder systems with a reactive organic medium. This type of ink material is converted to solderable pure metal during a low temperature cure without any organic binders or alloying elements.

A ferromagnetic conductively doped resin-based material may be formed of the present invention to create a magnetic or magnetizable form of the material. Ferromagnetic micron conductive fibers and/or ferromagnetic conductive powders are substantially homogenized with the base resin. Ferrite materials and/or rare earth magnetic materials are added as a conductive doping to the base resin. With the substantially homogeneous mixing of the ferromagnetic micron conductive fibers and/or micron conductive powders, the ferromagnetic conductively doped resin-based material is able to produce an excellent low cost, low weight, high aspect ratio magnetize-able item. The magnets and magnetic devices of the present invention can be magnetized during or after the molding process. Adjusting the doping levels and or dopants of ferromagnetic micron conductive fibers and/or ferromagnetic micron conductive powders that are homogenized within the base resin can control the magnetic strength of the magnets and magnetic devices. By increasing the aspect ratio of the ferromagnetic doping, the strength of the magnet or magnetic devices can be substantially increased. The substantially homogenous mixing of the conductive fibers/powders or in combinations there of allows for a substantial amount of dopants to be added to the base resin without causing the structural integrity of the item to decline mechanically. The ferromagnetic conductively doped resin-based magnets display outstanding physical properties of the base resin, including flexibility, moldability, strength, and resistance to environmental corrosion, along with superior magnetic ability. In addition, the unique ferromagnetic conductively doped resin-based material facilitates formation of items that exhibit superior thermal and electrical conductivity as well as magnetism.

A high aspect ratio magnet is easily achieved through the use of ferromagnetic conductive micron fiber or through the combination of ferromagnetic micron powder with conductive micron fiber. The use of micron conductive fiber allows for molding articles with a high aspect ratio of conductive fibers/powders or combinations there of in a cross sectional area. If a ferromagnetic micron fiber is used, then this high aspect ratio translates into a high quality magnetic article. Alternatively, if a ferromagnetic micron powder is combined with micron conductive fiber, then the magnetic effect of the powder is effectively spread throughout the molded article via the network of conductive fiber such that an effective high aspect ratio molded magnetic article is achieved. The ferromagnetic conductively doped resin-based material may be magnetized, after molding, by exposing the molded article to a strong magnetic field. Alternatively, a strong magnetic field may be used to magnetize the ferromagnetic conductively doped resin-based material during the molding process.

The ferromagnetic conductively doped is in the form of fiber, powder, or a combination of fiber and powder. The micron conductive powder may be metal fiber or metal plated fiber or powders. If metal plated fiber is used, then the core fiber is a platable material and may be metal or non-metal. Exemplary ferromagnetic conductive fiber materials include ferrite, or ceramic, materials as nickel zinc, manganese zinc, and combinations of iron, boron, and strontium, and the like. In addition, rare earth elements, such as neodymium and samarium, typified by neodymium-iron-boron, samarium-cobalt, and the like, are useful ferromagnetic conductive fiber materials. Exemplary ferromagnetic micron powder leached onto the conductive fibers include ferrite, or ceramic, materials as nickel zinc, manganese zinc, and combinations of iron, boron, and strontium, and the like. In addition, rare earth elements, such as neodymium and samarium, typified by neodymium-iron-boron, samarium-cobalt, and the like, are useful ferromagnetic conductive powder materials. A ferromagnetic conductive doping may be combined with a non-ferromagnetic conductive doping to form a conductively doped resin-based material that combines excellent conductive qualities with magnetic capabilities.

According to various embodiments of the present invention, a wide variety of microwave oven components may be formed, at least in part, of conductively doped resin-based materials. Components including, but are not limited to, microwave antennas, electrical contacts, transformer casings, magnetron tube components and casings, cooling fins, radiation sealing gaskets, wave dispersing fans, waveguides, cooking chambers, LED lighting and circuits, other lighting circuits, lighting terminals, wiring harnesses, conduit, fuses, and exterior cases may be formed of conductively doped resin-based materials. Numerous exemplary embodiments of the above microwave components are illustrated herein.

Referring now to FIG. 1, an embodiment of a microwave oven 10 is shown in cross-sectional representation. The microwave oven 10 comprises a microwave antenna 14, a magnetron 18, magnetron cooling fins 16, a transformer 20, various electrical contacts 22, a radiation sealing gasket, a wave dispersing fan 24, a waveguide 23, a cooking chamber 25, and an outer case 12 assembled in a conventional arrangement. However, in the present invention any one, several, or all of these components are formed of conductively doped resin-based material.

Typically microwave ovens operate at about 2.5 Giga Hertz (2.5 GHz). The magnetron 18, transformer 20, and antenna 14 convert electrical energy into radiated microwave electromagnetic energy as is well known in the art. During cooking operation, this microwave energy travels through a waveguide 23 into a cooking chamber 25. To improve the cooking performance of the oven 10, a wave dispersing fan 24 is frequently used to eliminate standing electromagnetic waves and to thereby reduce hot spots in the cooking area 29. The cooking chamber 25 provides support for objects placed into the oven. The cooking chamber 25 and waveguide 23 also provides means to trap microwave energy within the guide channel 27 and the chamber region 29 such that energy does not escape the appliance 10 as is well known in the art.

The conductively doped resin-based material of the present invention can be tailored for application to a variety of microwave oven components. The material exhibits excellent electromagnetic energy transmission properties over a large, yet tunable, frequency range. Therefore, conductively doped resin-based antennas 14 may be manufactured that exhibit low loss radiation of microwave power. The conductively doped resin-based material exhibits excellent thermal conductivity. Therefore, various components, such as magnetron cooling fins 16, power supply cooling fins, and microwave cases 12 can be advantageously formed of the conductively doped resin-based material to generated needed thermal energy dissipation with low weight. The conductively doped resin-based material exhibits excellent absorption of electromagnetic energy. Therefore, microwave oven cases 12 formed of the material provide excellent barriers to the unwanted emission of microwave energy by the appliance. The conductively doped resin-based material exhibits excellent electrical conductivity. Therefore, electrical device cases 18 and the oven case 12 can be formed of a material that is light weight, relative to metal, while still providing an excellent grounding structure.

The conductively doped resin-based material may be optimized to maximize reflection of microwave energy while minimizing absorption. In one embodiment, the base resin, the conductive doping type, and the conductive doping percentage are selected to maximize reflection and minimize absorption of the microwave energy. In another embodiment the conductively doped resin-based material is metal coated or plated to maximize reflection and minimize absorption of the microwave energy. In yet another embodiment the conductively doped resin-based material is coated with a conductive paint to maximize reflection and minimize absorption of the microwave energy. Waveguides 23, cooking chambers 25, wave dispersing fans 24 may be formed of the conductively doped resin-based material using these reflection optimizing methods.

The conductively doped resin-based material may be made magnetic by incorporating a ferromagnetic doping. Therefore, permanent magnets 28 for a magnetron 18 may be formed from magnetically doped resin-based material.

In addition to the above product features, the use of the conductively doped resin-based material also provides manufacturing advantages. Plastics molding methods are used to form the components. Molding operations are less complex and expensive to operate than traditional metal sheet stamping, bending and assembly processes. More intricate component designs can be realized via plastics molding methods. Several components may be molded in a single operation or molded together via insertion molding operations. For example, it is possible to mold both the magnetron casing 18 and cooling fins 16 in a single operation. It is possible to mold the wave guide 23 and cooking chamber 25 in a single operation.

Figure 7:
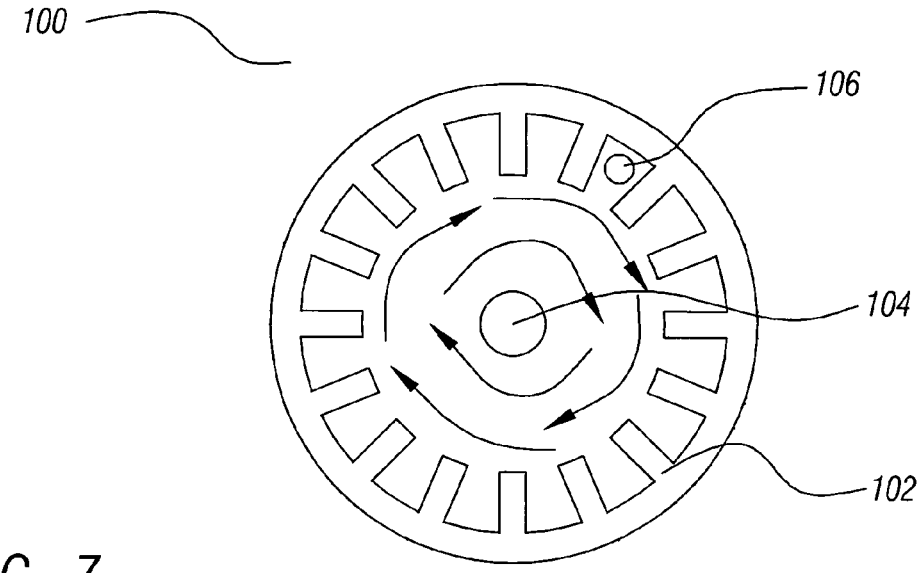
FIG. 7 illustrates an embodiment of a magnetron device, in cross section, comprising conductively doped resin-based material of the present invention.

Referring now to FIG. 7, an embodiment of a magnetron tube 100 is shown in cross-sectional representation. A magnetron tube 100 is used in a microwave oven to generate a high frequency, cooking energy signal. A low DC voltage is applied to the center cathode 104, or filament. This voltage causes electrons to "boil off" of the cathode 104. A magnetron transformer converts incoming electrical power to a very large DC voltage. This large DC voltage is applied to the anode 102 that surrounds the center cathode 104. The large voltage causes the "boiled of" electrons to be accelerated towards the anode 102. However, as shown in FIG. 1, two large permanent magnets 28 are mounted above and below the cathode and anode area of the magnetron. As a result, and referring again to FIG. 7, an electromagnetic field is applied to the free electrons. The combination of the magnetic field and the anode voltage causes the electrons to orbit around the center cathode 104, while spiraling outward toward the anode 102. The anode 102 is designed to have a series of lobes that act as resonance cavities. These cavities cause the tube to resonate at the microwave frequency. An antenna probe 106 is placed in one of the cavities to pick up the signal. The antenna 106 then transmits and radiates this energy signal through the waveguide 27 and into the cooking chamber 29 as shown in FIG. 1.

In various embodiments, any, several, or all components of a magnetron tube 100 may comprise conductively doped resin-based material in the present invention. In particular, according to one embodiment, the anode 102 is formed of conductively doped resin-based material. In another embodiment the anode 102 is formed of the conductively doped resin-based material of the present invention. In another embodiment the anode 102 is formed of conductively doped resin-based material and then metal plated or metal coated. In yet a further embodiment the anode 102 is formed of metal and then coated with an outer layer the conductively doped resin-based material. In another embodiment the antenna probe 106 is formed entirely of the conductively doped resin-based material of the present invention. In another embodiment the antenna probe 106 is formed of conductively doped resin-based material and then metal plated or metal coated. In yet a further embodiment the antenna probe 106 is formed of metal and then coated with an outer layer the conductively doped resin-based material.

Figure 8:
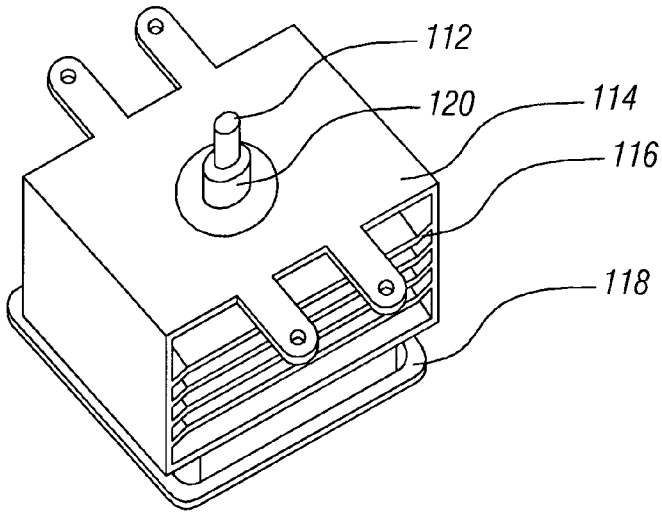
FIG. 8 illustrates an embodiment of a magnetron device, in external view, comprising conductively doped resin-based material of the present invention.

Referring now to FIG. 8, an embodiment of a magnetron tube assembly 110 is shown in external view. The magnetron tube assembly 110 comprises components of the conductively doped resin-based material of the present invention. In particular, any, several, or all components, such as a microwave antenna 112, a radiation sealing gasket 120, a magnetron outer casing 114, magnetron cooling fins 116, and a transformer outer casing 118 are formed of the conductively doped resin-based material of the present invention.

In yet other embodiments, the microwave electronic control system (not shown) contains various components comprising the conductively doped resin-based material of the present invention. Electrical wiring, wiring harnesses, switches, lighting components, connectors, circuit boards, key pad devices, and the like, are formed of the conductively doped resin-based material of the present invention.

Figure 2:
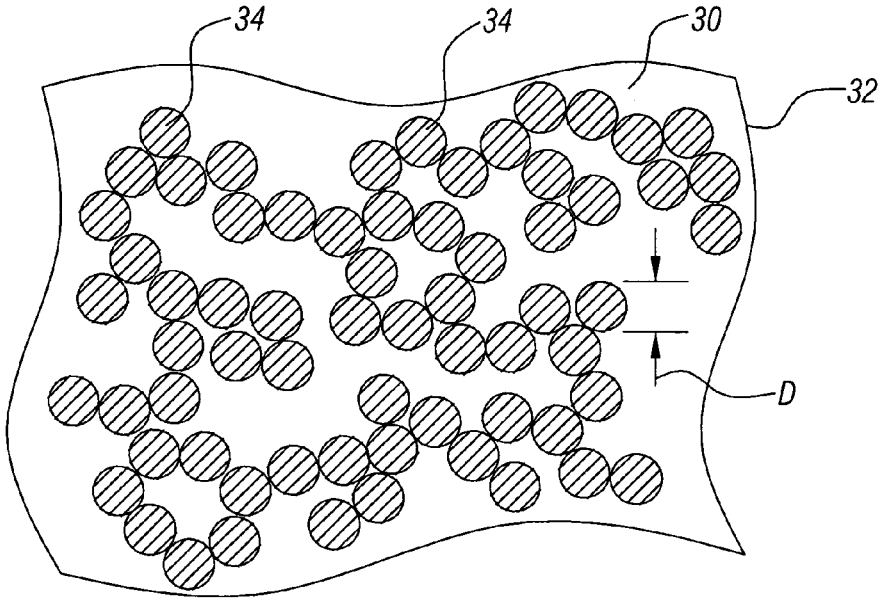
FIG. 2 illustrates a first preferred embodiment of a conductively doped resin-based material wherein the conductive materials comprise a powder.

The conductively doped resin-based material typically comprises a micron powder(s) of conductor particles and/or in combination of micron fiber(s) substantially homogenized within a base resin host. FIG. 2 shows a cross section view of an example of conductively doped resin-based material 32 having powder of conductor particles 34 in a base resin host 30. In this example the diameter D of the conductor particles 34 in the powder is between about 3 and 12 microns.

Figure 3:
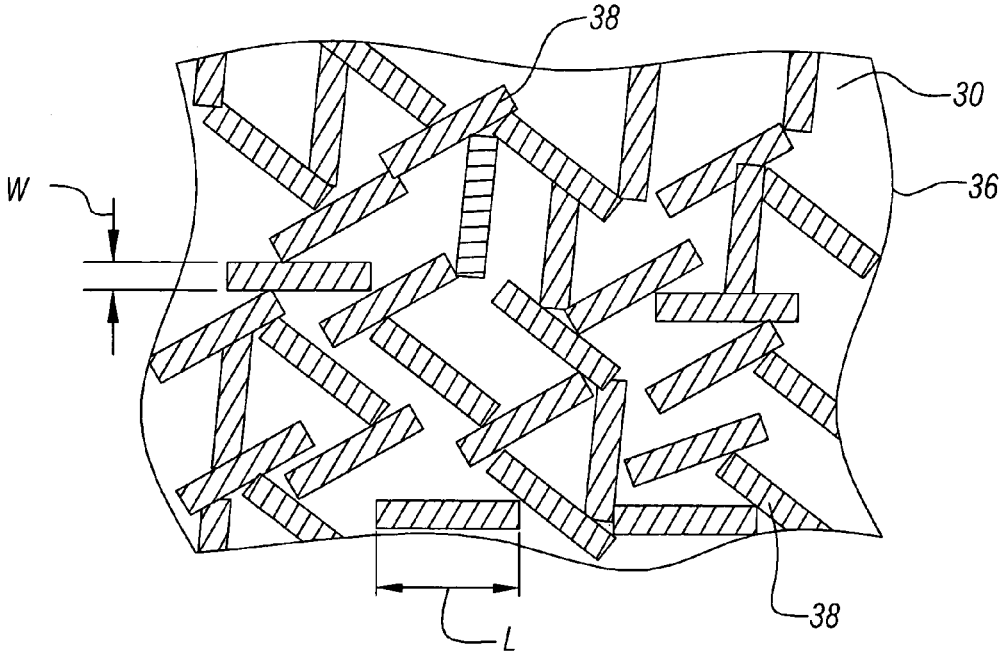
FIG. 3 illustrates a second preferred embodiment of a conductively doped resin-based material wherein the conductive materials comprise micron conductive fibers.

FIG. 3 shows a cross section view of an example of conductively doped resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The micron conductive fibers 38 may be metal fiber or metal plated fiber. Further, the metal plated fiber may be formed by plating metal onto a metal fiber or by plating metal onto a non-metal fiber. Exemplary metal fibers include, but are not limited to, stainless steel fiber, copper fiber, nickel fiber, silver fiber, aluminum fiber, nichrome fiber, or the like, or combinations thereof. Exemplary metal plating materials include, but are not limited to, copper, nickel, cobalt, silver, gold, palladium, platinum, ruthenium, rhodium, and nichrome, and alloys of thereof. Any platable fiber may be used as the core for a non-metal fiber. Exemplary non-metal fibers include, but are not limited to, carbon, graphite, polyester, basalt, man-made and naturally-occurring materials, and the like. In addition, superconductor metals, such as titanium, nickel, niobium, and zirconium, and alloys of titanium, nickel, niobium, and zirconium may also be used as micron conductive fibers and/or as metal plating onto fibers in the present invention.

These conductor particles and/or fibers are substantially homogenized within a base resin. As previously mentioned, the conductively doped resin-based materials have a sheet resistance of less than about 5 to more than about 25 ohms per square, though other values can be achieved by varying the doping parameters and/or resin selection. To realize this sheet resistance the weight of the conductor material comprises between about 20% and about 50% of the total weight of the conductively doped resin-based material. More preferably, the weight of the conductive material comprises between about 20% and about 40% of the total weight of the conductively doped resin-based material. More preferably yet, the weight of the conductive material comprises between about 25% and about 35% of the total weight of the conductively doped resin-based material. Still more preferably yet, the weight of the conductive material comprises about 30% of the total weight of the conductively doped resin-based material. Stainless Steel Fiber of 6-12 micron in diameter and lengths of 4-6 mm and comprising, by weight, about 30% of the total weight of the conductively doped resin-based material will produce a very highly conductive parameter, efficient within any EMF, thermal, acoustic, or electronic spectrum.

In yet another preferred embodiment of the present invention, the conductive doping is determined using a volume percentage. In a most preferred embodiment, the conductive doping comprises a volume of between about 4% and about 10% of the total volume of the conductively doped resin-based material. In a less preferred embodiment, the conductive doping comprises a volume of between about 1% and about 50% of the total volume of the conductively doped resin-based material though the properties of the base resin may be impacted by high percent volume doping.

Figure 4:
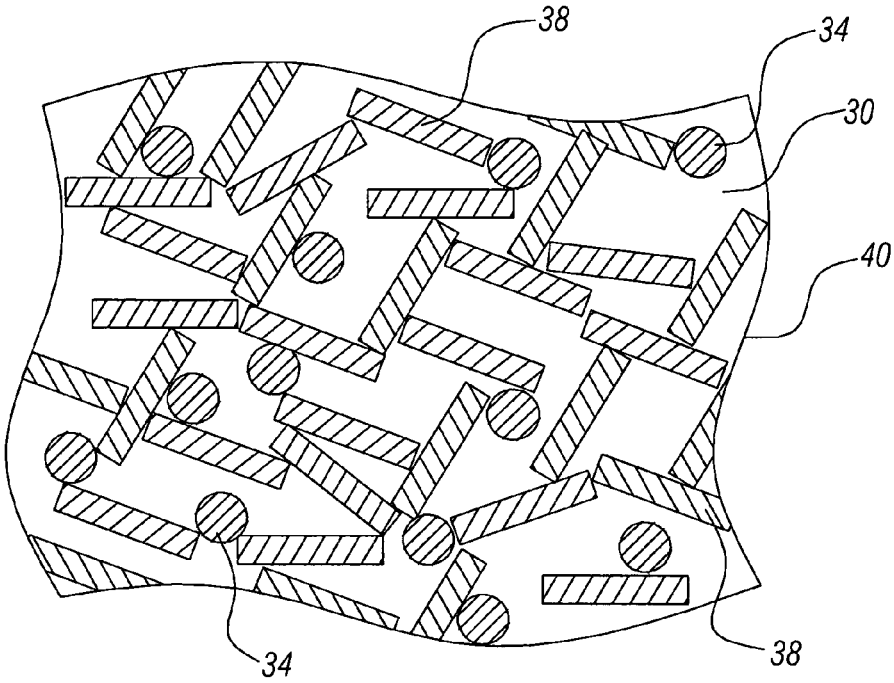
FIG. 4 illustrates a third preferred embodiment of a conductively doped resin-based material wherein the conductive materials comprise both conductive powder and micron conductive fibers.

Referring now to FIG. 4, another preferred embodiment of the present invention is illustrated where the conductive materials comprise a combination of both conductive powders 34 and micron conductive fibers 38 substantially homogenized together within the resin base 30 during a molding process.

Figure 5A:
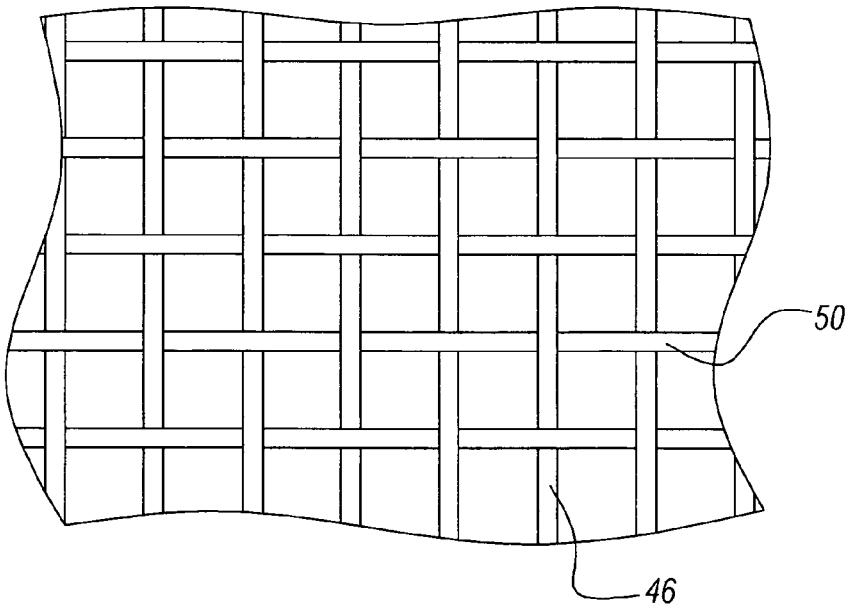
FIGS. 5*a* and 5*b* illustrate a fourth preferred embodiment wherein conductive fabric-like materials are formed from the conductively doped resin-based material.
Figure 5B:
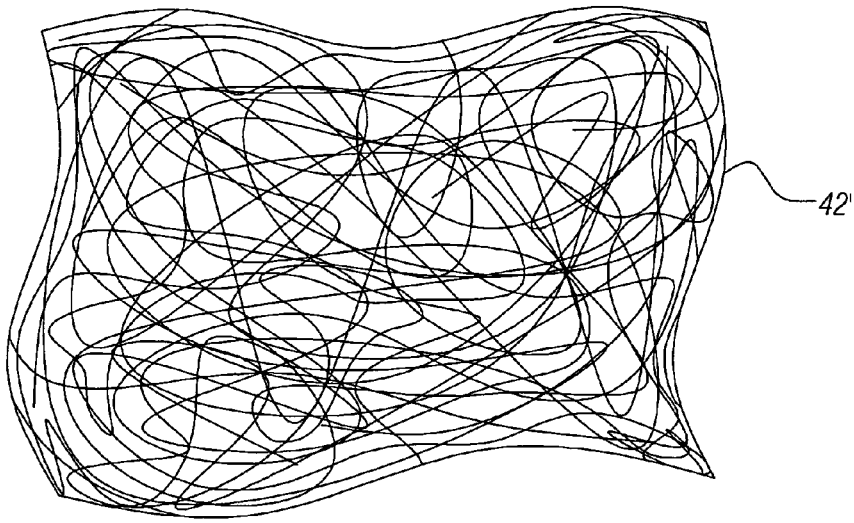

Referring now to FIGS. 5*a* and 5*b*, a preferred composition of the conductively doped, resin-based material is illustrated. The conductively doped resin-based material can be formed into fibers or textiles that are then woven or webbed into a conductive fabric. The conductively doped resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
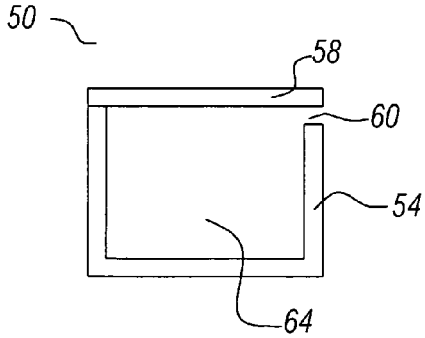
FIGS. 6*a* and 6*b* illustrate, in simplified schematic form, an injection molding apparatus and an extrusion molding apparatus that may be used to mold microwave oven components of a conductively doped resin-based material.

Articles formed from conductively doped resin-based materials can be formed or molded in a number of different ways including injection molding, extrusion, calendaring, compression molding, thermoset molding, or chemically induced molding or forming. FIG. 6*a* shows a simplified schematic diagram of an injection mold showing a lower portion 54 and upper portion 58 of the mold 50. Conductively doped resin-based material is injected into the mold cavity 64 through an injection opening 60 and then the substantially homogenized conductive material cures by thermal reaction. The upper portion 58 and lower portion 54 of the mold are then separated or parted and the articles are removed.

Figure 6B:
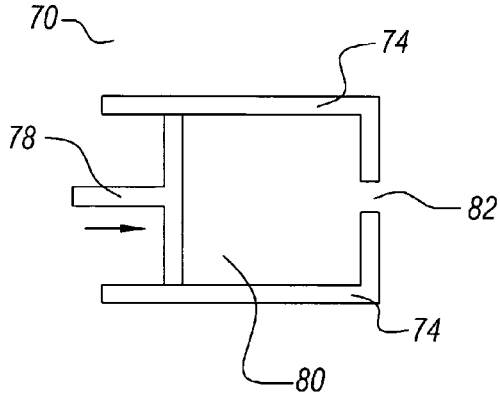

FIG. 6*b* shows a simplified schematic diagram of an extruder 70 for forming articles using extrusion. Conductively doped resin-based material(s) is placed in the hopper 80 of the extrusion unit 74. A piston, screw, press or other means 78 is then used to force thermally molten, chemically-induced compression, or thermoset curing conductively doped resin-based material through an extrusion opening 82 which shapes the thermally molten curing or chemically induced cured conductively doped resin-based material to the desired shape. The conductively doped resin-based material is then fully cured by chemical reaction or thermal reaction to a hardened or pliable state and is ready for use. Thermoplastic or thermosetting resin-based materials and associated processes may be used in molding the conductively doped resin-based articles of the present invention.

The advantages of the present invention may now be summarized. An effective microwave oven device is achieved. A method to form a microwave oven device is achieved. Microwave oven components are molded of conductively doped resin-based materials. The electromagnetic, electrical, thermal, acoustical, or visual characteristics of the microwave components can be altered or the visual characteristics can be altered by forming a metal layer over the conductively doped resin-based material. A microwave magnetron case exhibiting both low weight and excellent thermal dissipation may be achieved. A microwave wave guide exhibiting excellent microwave transmission capability may be achieved. A microwave oven cooking chamber exhibiting excellent energy control may be achieved. A microwave oven chassis exhibiting both low weight and excellent energy control may be achieved. A microwave oven wave dispersing fan exhibiting excellent wave breakup and low weight may be achieved. A microwave oven antenna exhibiting excellent energy radiation may be achieved. A method to form microwave components of more intricate detail and with less manufacturing complexity is achieved.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the scope of the invention.

What is claimed is:

1. A microwave oven device comprising:

a magnetron capable of generating microwave energy wherein said magnetron comprises conductively doped, resin-based material comprising conductive fiber in a base resin host wherein the conductive fiber has a diameter of between 3 and 12 microns and a length of between 2 and 14 millimeters; and a cooking chamber electromagnetically coupled to said magnetron.

2. The device according to claim 1 wherein said conductive fiber further comprises a chemically inert coupling agent overlying said fiber.

3. The device according to claim 1 further comprising conductive powder has a diameter between about 3 and 12 microns.

4. The device according to claim 3 wherein said conductive powder is metal.

5. The device according to claim 3 wherein said conductive powder is a non-metal core with a metal layer plated thereon.

6. The device according to claim 1 wherein said magnetron comprises an antenna comprising said conductively doped resin-based material.

7. The device according to claim 1 wherein said magnetron comprises a heat dissipation structure comprising said conductively doped resin-based material.

8. A microwave oven device comprising:

a magnetron capable of generating microwave energy wherein said magnetron comprises conductively doped, resin-based material comprising conductive fiber in a base resin host wherein the conductive fiber has a diameter of between 3 and 12 microns and a length of between 2 and 14 millimeters and wherein the conductive fiber is a non-metal core with a metal layer plated thereon; and a cooking chamber electromagnetically coupled to said magnetron.

9. The device according to claim 1 wherein said conductive fiber further comprises a chemically inert coupling agent overlying said fiber.

10. The device according to claim 1 further comprising conductive powder has a diameter between about 3 and 12 microns.

11. The device according to claim 3 wherein said conductive powder is metal.

12. The device according to claim 3 wherein said conductive powder is a non-metal core with a metal layer plated thereon.

13. The device according to claim 1 wherein said magnetron comprises an antenna comprising said conductively doped resin-based material.

14. The device according to claim 1 wherein said magnetron comprises a heat dissipation structure comprising said conductively doped resin-based material.

15. A microwave oven device comprising:

a magnetron capable of generating microwave energy wherein said magnetron comprises conductively doped, resin-based material comprising conductive fiber in a base resin host wherein the conductive fiber has a diameter of between 3 and 12 microns and a length of between 2 and 14 millimeters and wherein the conductive fiber is metal or metal alloy; and a cooking chamber electromagnetically coupled to said magnetron.

16. The device according to claim 1 wherein said conductive fiber further comprises a chemically inert coupling agent overlying said fiber.

17. The device according to claim 1 further comprising conductive powder has a diameter between about 3 and 12 microns.

18. The device according to claim 3 wherein said conductive powder is metal.

19. The device according to claim 3 wherein said conductive powder is a non-metal core with a metal layer plated thereon.

20. The device according to claim 1 wherein said magnetron comprises an antenna comprising said conductively doped resin-based material.

21. The device according to claim 1 wherein said magnetron comprises a heat dissipation structure comprising said conductively doped resin-based material.

* * * * *